US005100201A

United States Patent [19]

Becker, III et al.

[11] Patent Number: 5,100,201

[45] Date of Patent: Mar. 31, 1992

[54] PASSIVE ERGONOMIC WORK CHAIR

[75] Inventors: William J. Becker, III, Silverdale; Philip K. Donnelly, Trumbauersville, both of Pa.

[73] Assignee: J.G. Furniture Systems Inc., Quakertown, Pa.

[21] Appl. No.: 586,231

[22] Filed: Sep. 21, 1990

[51] Int. Cl.[5] ..... A47C 3/00

[52] U.S. Cl. ..... 297/300; 297/296; 297/306

[58] Field of Search ..... 297/296–301, 297/304, 309, 312

[56] References Cited

U.S. PATENT DOCUMENTS

| | | | |
|---|---|---|---|
| 4,084,850 | 4/1978 | Ambasz | 297/300 |
| 4,498,702 | 2/1985 | Raftery | 297/312 |
| 4,555,136 | 11/1985 | Dranger | 297/306 |
| 4,580,836 | 4/1986 | Verney | 297/296 |
| 4,585,272 | 4/1986 | Ballarini | 297/300 X |
| 4,711,491 | 12/1987 | Ginat | 297/301 |
| 4,733,910 | 3/1988 | Brennan | 297/300 |
| 4,869,552 | 9/1989 | Tolleson et al. | 297/306 X |
| 4,938,532 | 7/1990 | Burgess | 297/301 |

FOREIGN PATENT DOCUMENTS

| | | | |
|---|---|---|---|
| 610741 | 10/1948 | United Kingdom | 297/296 |

*Primary Examiner*—Peter A. Aschenbrenner
*Attorney, Agent, or Firm*—Nixon & Vanderhye

[57] ABSTRACT

A personal office or work chair is provided which includes an open frame construction wherein a seat portion of the chair includes a pair of front springs mounted on either side of the frame, each spring located between frame members extending rearwardly toward the chair seat back portion of the chair, and forwardly to the front edge of the seat portion. In a preferred arrangement, each spring comprises a strip of non-woven fiberglass epoxy resin including forward and rearward substantially planar mounting portions.

At the same time, the seat back portion of the chair includes an open frame wherein a pair of laterally spaced frame members are hingedly secured to the corresponding laterally spaced frame members of the seat portion by a hinge bar or rod extending across the frame. One each side of the frame, there is a relatively rigid but somewhat flexible plastic spring fixedly secured between adjacent seat frame and seat back frame members, overlapping the hinged connection between the seat and seat back frame portions. These relatively rigid plastic springs are generally L-shaped and are fixedly riveted to the seat frame members.

29 Claims, 4 Drawing Sheets

FIG. 1
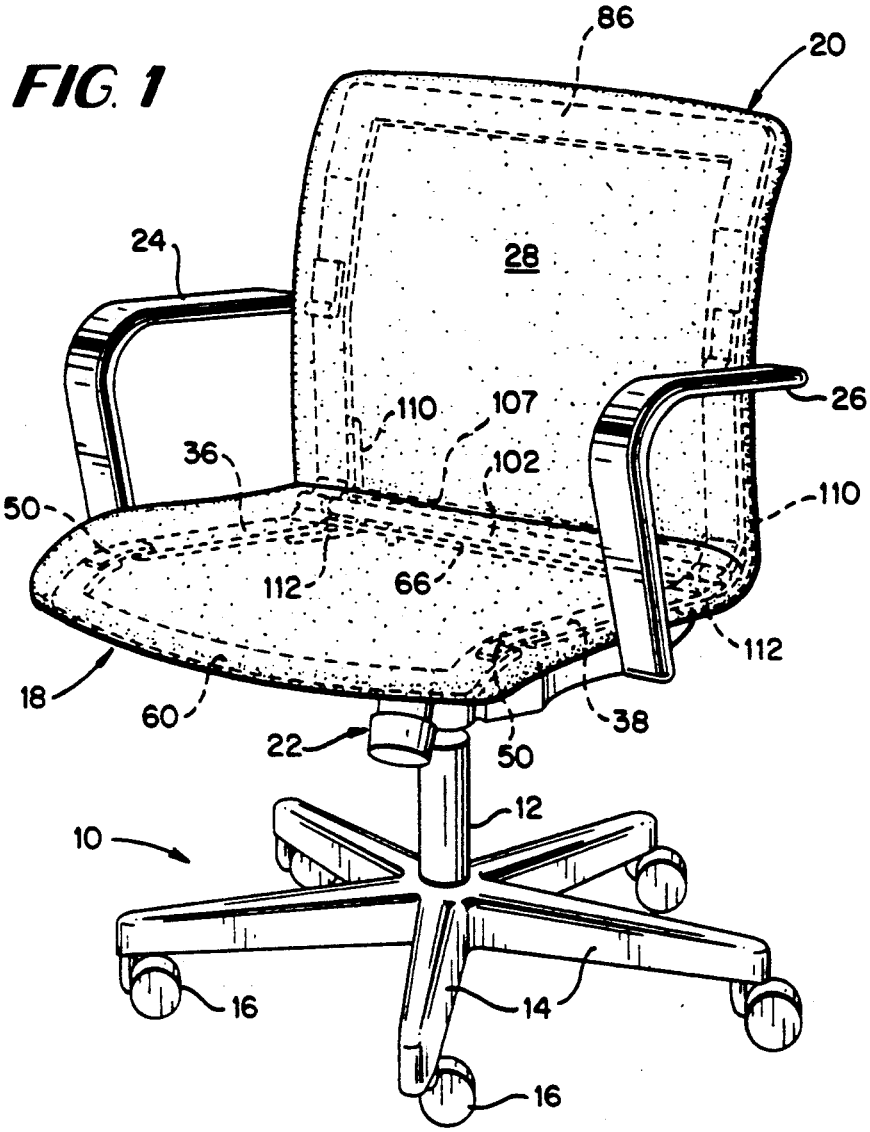
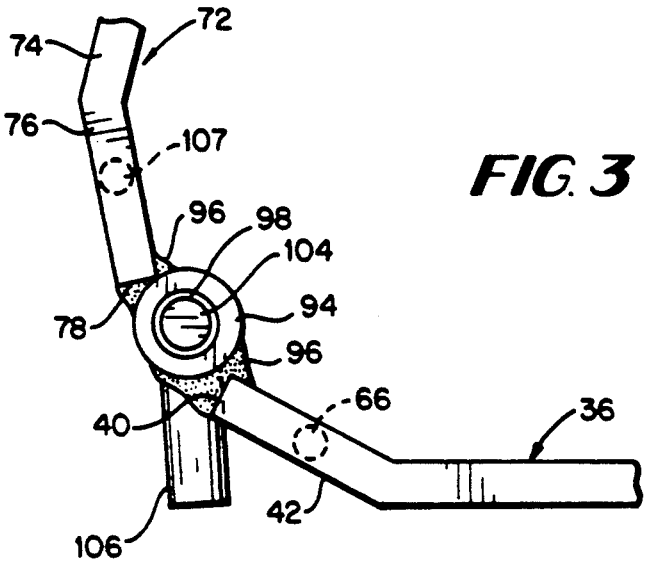
FIG. 3

PASSIVE ERGONOMIC WORK CHAIR

FIELD OF THE INVENTION

This invention relates generally to work chairs which provide various degrees of adjustability for affording optimum comfort to the user. More particularly, this invention relates to chairs which permit passive tilting of the seat portion as well as flexing or tilting of the seat back relative to the seat.

BACKGROUND OF THE INVENTION

There are many office chair designs which generally incorporate a tilt type control mechanism connecting the upper end of, for example, a conventional pedestal type base to the seat portion of the chair. This arrangement provides a substantially horizontal tilt axis which extends sideways across the seat portion directly adjacent the underside thereof, with the tilt axis generally disposed substantially directly over the pedestal and approximately midway between the front and rear edges of the seat. With this type of arrangement, rearward tilting of the seat portion results in the rear edge of the seat swinging downwardly and, simultaneously, the front edge of the seat swinging upwardly, thereby causing an undesirable lifting of the occupant's legs in the vicinity of the knees and thighs.

It is also known, of course, to provide flexing or tilting movement of the seat back portion of the chair relative to the seat portion by a hinged frame arrangement. However, such arrangements have not been completely satisfactory for lack of precise control of the flexing action of the seat back portion.

This invention provides a solution to both of the above mentioned problems by the unique arrangement of springs incorporated within the chair frame. Thus, in accordance with the present invention, the front edge of the seat portion flexes during the tilting of the seat portion of the chair, thus eliminating the aforementioned lifting of the pressure under the thighs. In addition, the seat back portion of the chair flexes independently of the seat tilt function of the pedestal base, thus delivering a correct amount of lumbar support in both the tilt and optional tilt lock modes.

In accordance with another feature of the invention, a continuous chair suspension system is provided wherein a steel seat/back frame is wrapped with a continuous suspension material, enveloped in urethane foam, and covered with upholstery, so that the occupant never "bottoms out" on a solid seat shell. The occupant thus remains cool from the continual exchange of air that flows through the seat suspension and padding. This eliminates the so-called "hot seat" syndrome commonly associated with solid shell chairs.

In accordance with one exemplary embodiment of the invention, therefore, a personal office or work chair is provided which includes an open frame construction wherein a seat portion of the chair includes a pair of front springs mounted on either side of the frame, each spring located between frame members extending rearwardly toward the chair seat back portion of the chair, and forwardly to the front edge of the seat portion. In a preferred arrangement, each spring comprises a strip of non-woven fiberglass epoxy resin material. These springs permit the forward portion of the seat frame, including a laterally extending forward frame member which connects the laterally spaced frame members, to flex downwardly upon rearward tilting of the seat portion of the chair. As a result, the tendency to lift the occupant's legs upwardly is lessened.

At the same time, the seat back portion of the chair includes an open frame wherein a pair of laterally spaced frame members are hingedly secured to the corresponding laterally spaced frame members of the seat portion by a hinge bar or rod extending across the frame. On each side of the frame, there is a relatively rigid but somewhat flexible plastic spring fixedly secured between adjacent seat frame and seat back frame members, overlapping the hinged connection between the seat and seat back frame portions. These relatively rigid plastic springs are generally L-shaped and are fixedly riveted to the seat frame members.

The pair of relatively rigid plastic springs are designed to provide controlled flexing of the seat back portion of the chair relative to the seat portion, as will be explained in greater detail further herein.

It is a further feature of the invention that rearward tilting of the seat back portion of the chair relative to the seat portion is limited by stop elements mounted on the hinge bar or rod and which are designed to engage a laterally extending, fixed bracing rod at the maximum tilt position.

In accordance with an exemplary embodiment of the invention therefore, there is provided a back spring adapted for connection between a seat frame portion and a seat back frame portion of a chair frame, the back spring comprising a relatively rigid but flexible member having a seat frame engaging portion and a seat back frame engaging portion, and an integral, arcuate hinge portion extending therebetween.

In another aspect of the invention, there is provided a front spring adapted for connection between a seat frame portion and a front lip portion of a chair frame, the front spring comprising a front lip engaging portion, and a seat frame engaging portion, wherein the front lip engaging portion and the seat engaging portion lie substantially in a single plane.

In another aspect, the invention provides a passive ergonomic chair comprising: an open frame construction including a seat back frame portion; a hinge connecting the seat frame portion to the seat back frame portion; a pair of rearward springs underlying respective end bushings of the hinge, each of the rearward springs comprising a relatively rigid curved member having a seat frame engaging portion and a seat back frame engaging portion, and an arcuate portion extending therebetween, the seat frame engaging portion being secured to the seat frame portion.

In still another aspect, the present invention provides an ergonomic chair wherein the seat frame portion includes: a forward lip portion extending across a forward end of the seat frame portion; and a pair of front springs adapted for connection between the seat portion and the forward lip portion of the frame, each of the front springs comprising a substantially straight forward lip engaging portion, and a substantially straight seat frame engaging portion, wherein the forward lip engaging portion and the seat engaging portion of each of the front springs lie substantially in a single plane.

In still another aspect, the present invention provides an ergonomic chair comprising: a substantially open frame construction including a seat frame portion and a seat back frame portion; a hinge connecting the seat frame portion to the seat back frame portion; a pair of rearward spring members underlying respective opposite end portions of the hinge, each of the springs comprising a relatively rigid member having a seat frame engaging portion and a seat back frame engaging portion, and an arcuate portion extending therebetween, the seat frame engaging portion fixed to the set frame portion; a forward lip portion extending across a forward end of the seat frame portion; a pair of front springs adapted for connection between the seat frame portion and the front lip portion of the chair frame, each of the front springs comprising a substantially straight forward lip engaging portion, and a substantially straight seat frame engaging portion; and means for limiting movement of the seat back frame portion relative to the seat frame portion.

BRIEF DESCRIPTION OF THE DRAWINGS

FIG. 1 is a perspective view of one exemplary embodiment of a work chair in accordance with the present invention;

FIG. 3 is a partial, enlarged side view of a hinge connection between adjacent seat frame and seat back frame members of the type illustrated in FIG. 2;

DETAILED DESCRIPTION OF THE DRAWINGS

Figure 2:
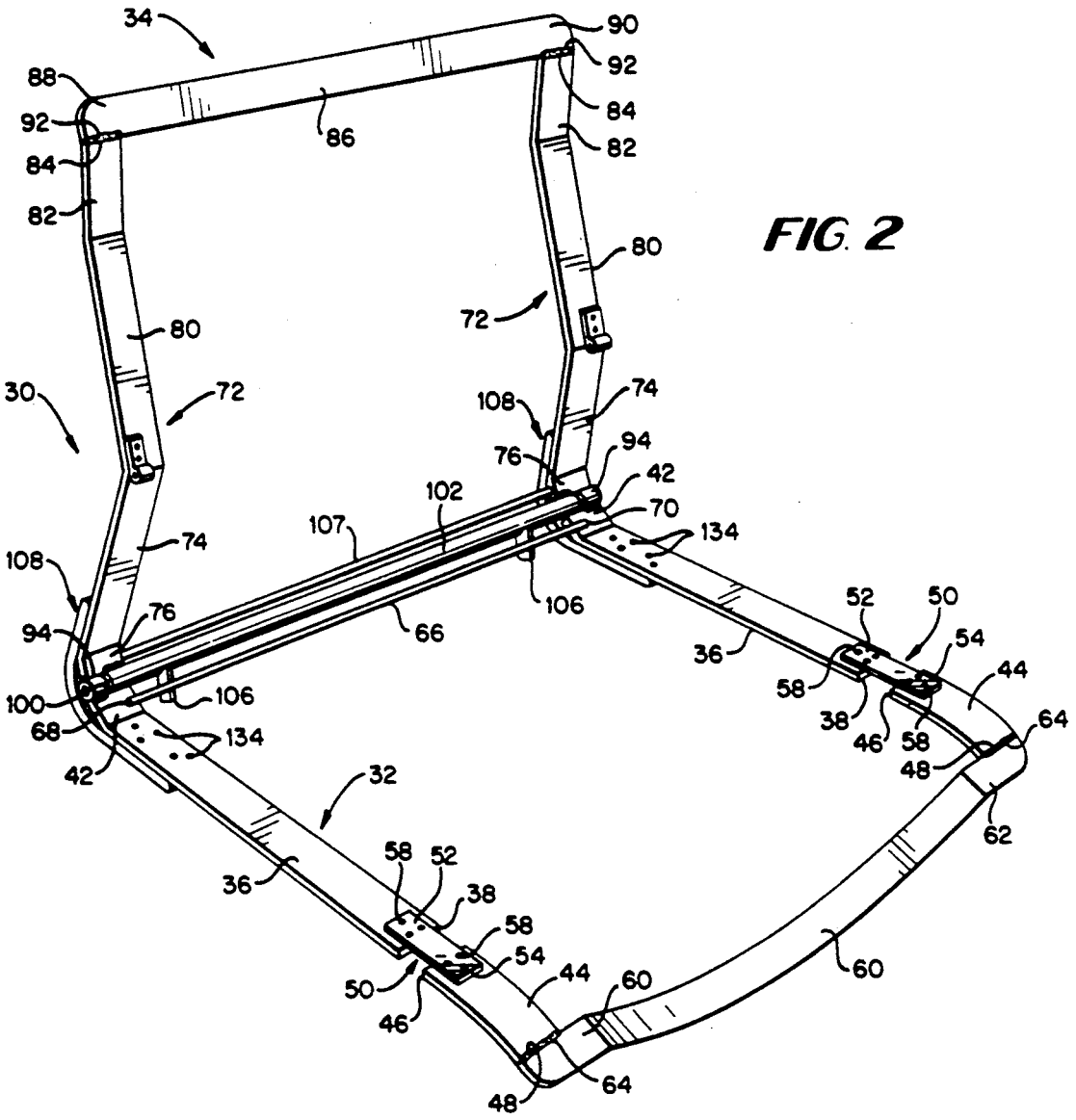
FIG. 2 is a perspective view of an internal frame for the chair shown in FIG. 1.

Referring initially to FIG. 1, a passive ergonomic chair in accordance with an exemplary embodiment of this invention generally includes a conventional pedestal base 10, having a central pedestal column 12, radially extending legs 14 and casters 16. The pedestal column 12 encloses a conventional piston and cylinder assembly (not shown) for raising and lowering the seat portion 18 and seat back portion 20 of the chair to the desired height, relative to the base 10. The pedestal base may also include a conventional swivel-tilt chair control device 22 such as the Faultless T-700 control sold by the Faultless Caster Division of Babcock Industries, Inc. As shown, the chair also includes arms 24, 26, but it will be appreciated that the subject matter of this invention is applicable a variety of chairs with or without arms, with or without an extra high back, and with any number of known base configurations, etc.

Figure 5:
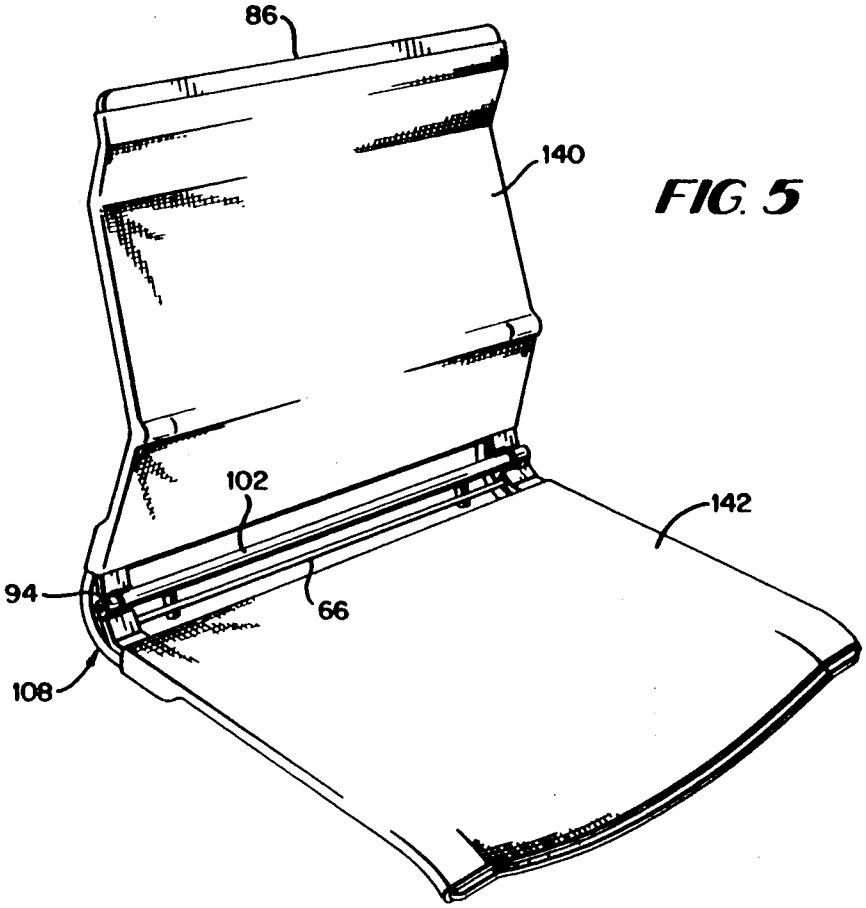
FIG. 5 is a perspective view of the chair frame illustrated in FIG. 4.

As will be described further below in connection with FIGS. 4 and 5, the chair illustrated in FIG. 1 also includes an open, continuous suspension system, i.e., a system where no solid, rigid shells are used to define the seat and seat back portions of the chair. Rather, the suspension comprises supporting fabric wrapped about an open frame, along with associated padding and upholstery (indicated at 28), so that the seat and seat back contact points remain cool from the continual exchange of air that flows through the fabric suspension system, padding, and upholstery material. This eliminates the so-called "hot seat" syndrome, commonly associated with solid shell chairs.

With reference now to FIG. 2, the interior open frame of the chair is shown generally at 30 and includes a seat frame portion 32 and a seat back frame portion 34. The seat frame portion 32 includes a pair of identical, elongated, relatively rigid steel alloy members 36, each of which has a forward edge 38 and a rearward edge 40 (see FIG. 3). A rearward portion 42 of each member 36 is turned upwardly, terminating at the edge 40.

The seat frame portion 32 also includes a pair of identical, forward elongated steel frame members 44 each of which has a rearward edge 46 and a forward edge 48. With reference particularly to FIGS. 2 and 4, it will be appreciated that each forward frame member 44 is curved downwardly toward its forward edge as defined by a curvature having a radius of preferably about 5.25 inches to thereby form a forward lip portion of the seat frame. These forward frame members 44 are connected to the frame members 36 by means of a pair of identical forward springs 50 preferably constructed from sheets of non-woven fiberglass epoxy resin but it will be understood that other material such as spring steel could also be used. Each spring 50 includes a rearward planar portion 52 and a forward planar portion 54. The planar portions 52, 54 are fixedly secured, preferably by rivets 58, to the forward and rearward ends of the frame members 36 and 44, respectively. Each spring 50 has a preferred thickness of about 0.130 inches, a width of about 1.5 inches and a length of about 4.0 inches.

The pair of forward frame members 44 are interconnected by a curved forward cross brace 60, opposite end portions 60, 62 of which are welded at 64 to the forward edges 48 of the forward frame members 44.

The springs 50 are arranged in so that downward pressure exerted on the cross brace 60 will cause forward frame members 44 and cross brace 60 (the forward lip portion of the seat frame) to flex relative to the frame members 36 in a manner described further hereinbelow.

With reference now particularly to FIGS. 2 and 3, a stop rod 66 is welded at opposite ends 68, 70 to the rearward portions of the laterally spaced frame members 36 in the turned up portions 42. The stop rod, which also serves to add rigidity to the frame, limits the flexing moment of the seat back portion as will be described further below.

Figure 4:
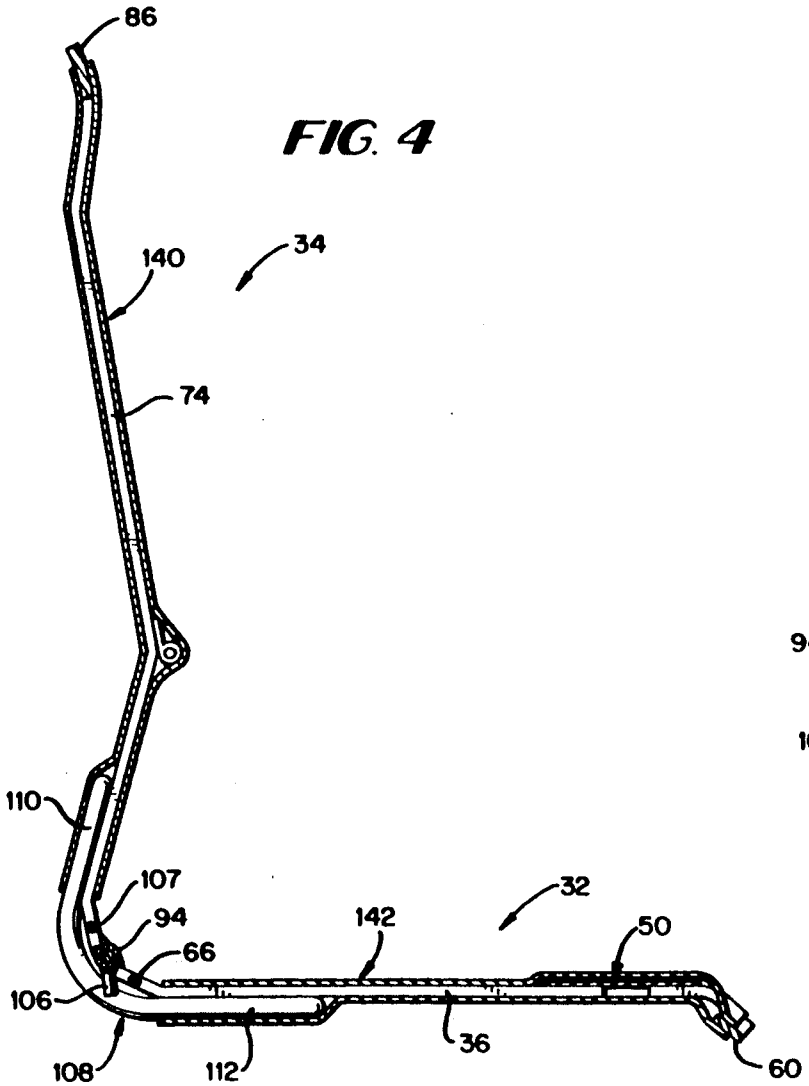
FIG. 4 is a side section view of the chair frame shown in FIG. 2, wrapped with suspension material.
Figure 9:
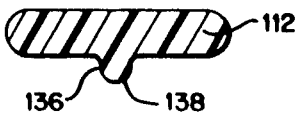
FIG. 9 is a cross sectional view of the spring illustrated in FIG. 6 taken along the lines 9—9 of FIG. 6.
Figure 8:
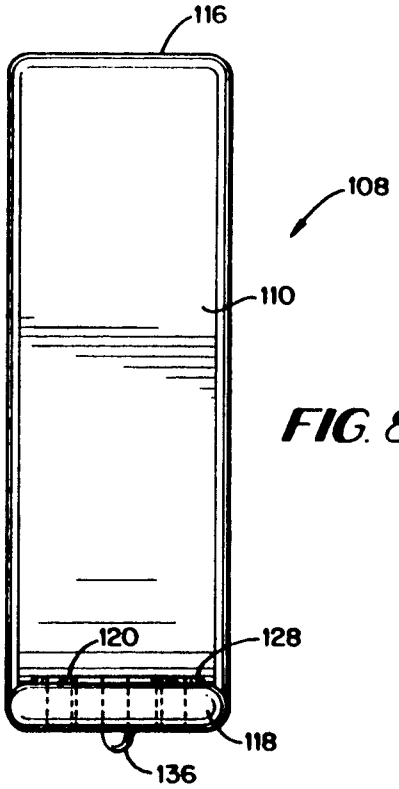
FIG. 8 is a front view of the spring illustrated in FIG. 6.
Figure 7:
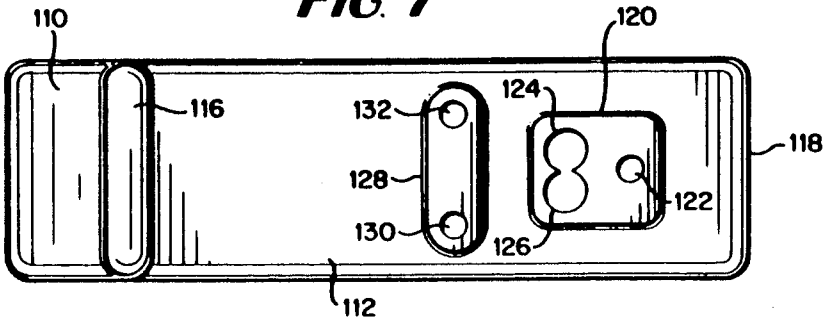
FIG. 7 is a plan view of the spring illustrated in FIG. 6.
Figure 6:
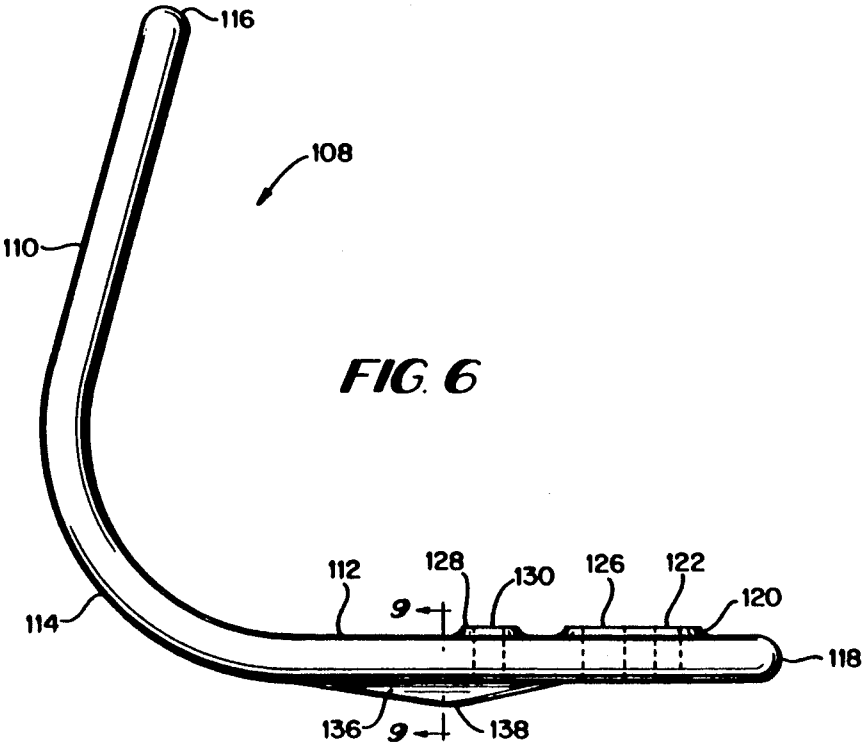
FIG. 6 is an enlarged side view of the spring secured between the seat frame and seat back frame members in FIG. 2.

Referring to FIGS. 2, 3 and 4, the seat back frame portion 34 includes a pair of identical, laterally spaced elongated frame members 72 constructed of similar material as the members 36 and 44 of the seat frame portion 32. The seat back frame members 72 each include a lower portion 74 terminating at an angled end portion 76 and a lowermost edge 78. An upper portion 80, integrally formed with the lower portion 74, has an angled portion 82 terminating in an upper edge 84. The pair of elongated frame members 72 are interconnected by a cross brace 86 welded at opposite end portions 88, 90 to the edges 84, as shown at 92.

With reference now particularly to FIGS. 2 and 3, it may be seen that a pair of identical hinge bushings 94 are interposed between the rearward edges 40 of the seat frame members 36 and edges 78 of the seat back frame members 72 and welded to the frame members 36 as shown at 96. Within each metal bushing 94 there is seated a T-shaped plastic (preferably Nylon) insert 98, with the radial flange portion 100 thereof facing inwardly, i.e., toward the opposite side of the chair frame. Extending between the bushings 94 and inserts 98, is a hinge bar 102 having reduced diameter end portions 104 seated within bores provided in the inserts 98. Portions of the bar 102 adjacent the reduced ends 104 are welded at 106 to the edges 78 of frame members 72. It will be appreciated that the radial flanges 100 will engage the shoulders of the hinge bar 102 at the interface with reduced diameter end portions 104 and thereby serve as washers facilitating the relative movement between the bushings 94 and hinge bar 102 during flexing of the seat back portion 20 relative to the seat portion 18 of the chair.

The hinge bar 102 is provided with a pair of downwardly extending stop elements 106, welded thereto at laterally spaced locations, and which are adapted to abut the stop rod 66 when the seat back frame portion 34 reaches a predetermined maximum rearward movement about bar 102 relative to the seat frame portion 32.

An additional bracing rod 107 may be provided to extend laterally between the angled portions 76 of the seat back frame members 72 to provide added rigidity if desired.

A pair of relatively rigid plastic springs 108, are fixedly secured to the rearward portion of the seat frame members 36 and extend rearwardly, curving around the hinge bar 102 and engaging the lower portions 74 of the seat back frame members 72. These springs are preferably constructed of 33% glass reinforced nylon.

As best seen in FIGS. 6–9, each of the springs 108 includes (relative to an in-use orientation) an upper inclined portion 110 (extending about 3.5 inches), and a lower substantially horizontal portion 112 (extending about 4.5 inches), interconnected by a radiused portion 114, to thereby result in an approximate L-shape. The radius of curvature in portion 114 is preferably about 1.8 inches and the included angle A between the portions 110 and 112 is approximately 75°. The springs each have a width of about two inches and a thickness less than 0.5 inch and preferably 0.406 inch.

Each spring 108 extends between an upper edge 16 and a forward edge 118, again relative to an in-use orientation on the chair frame. A raised boss 120 is provided in the horizontal portion 112 and fastening apertures 122, 124 and 126 are located within this raised boss area and extend through the thickness of the spring. A second raised boss 128 is provided behind the boss 120 and includes a pair of laterally spaced fastening apertures 130, 132 best seen in FIG. 7.

In a preferred arrangement, rivets 134 (FIG. 2) extending through apertures 122, 124, 128, 130 and 132 are utilized to attach the horizontal portions 112 of the springs 108 to the underside of frame members 36 as shown in FIGS. 2 and 4.

Centrally located on the underside of the horizontal portion 112 of each spring 108 is a reinforcing rib 136 which tapers forwardly and rearwardly from a centrally curved portion 138 having a radius of approximately one inch. The rib 136 is designed to add strength and rigidity to the horizontal portion 112 and to resist any fatiguing of the spring from repeated flexures over the useful life of the chair.

As will be appreciated from FIGS. 2 and 4, the springs 108 are rigidly secured to the rearward portions of frame members 36, but merely engage the lower portions 74 of the frame members 72. The springs 108 are nevertheless held stationary by reason of the multiple rivets 134 and the suspension material which is wrapped about the seat back portion as described further below.

The springs 108 are designed to control the flexing movement of the seat back frame portion 34 relative to the seat frame portion 32. Specifically, the springs 108 are designed to provide a preferred comfort range for the flexing action of the seat back portion 34 of the chair. The following chart indicates the seat back position in 5 degree increments, and the force required to move the seat back to the indicated position:

| BACK POSITION | FORCE APPLIED |
|---|---|
| 0° | 0 lbs. |
| 5° | 21 lbs. |
| 10° | 31.5 lbs. |
| 15° | 43 lbs. |

Figure 10:
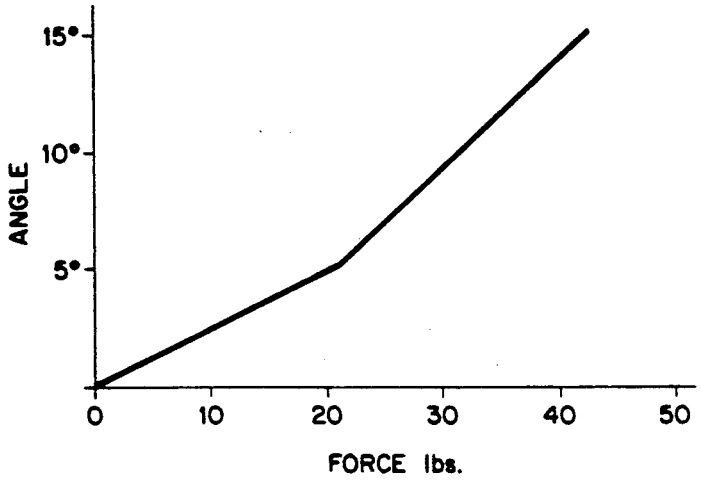
FIG. 10 is a graph illustrating the seat back angle as a function of force required to move the seat back to the indicated positions.

These figures were obtained as a result of force applied to an armless upper seat back portion 34 of a chair with no associated tilt mechanism. The force was measured 16 inches above the seat and approximately 90° to the back plane, at the back stop position. FIG. 10 represents a curve of the back position versus force applied, and displays a non-linear relationship with increasing resistance to flexure as the degree of flexure increases.

The above described arrangement provides a controlled, passive ergonomic "ride" for occupants of the chair which meets all BIFMA standards, and which provides a superior comfort zone in comparison to prior art passive chair designs.

At the same time, the spring hinged front edge portion of the seat frame portion 32 provides a simple, less costly and more dependable knee tilt arrangement than the conventional knee action front fulcrum controls utilized in the prior art. In addition, the front lip hinge permits front sitting declination for front pitching, independent of any flexing of the seat back frame portion 34.

Referring back to FIGS. 4 and 5, there is shown suspension material sleeves 140, 142 which are slidably received over the seat frame portion 32 and seat back frame portion 34, respectively. These sleeves are formed of conventional, resilient fabric material and serve as a supporting base for conventional foam padding (not shown) and upholstery 28 as will be appreciated by those of ordinary skill in the art. This arrangement allows for the continuous flow of air through the seat and seat back portions of the chair eliminating the "hot seat syndrome" as mentioned hereinabove.

It will be appreciated that the above described frame construction can be utilized with various types of chairs supported by various types of base constructions. For example, the frame construction can be utilized with high back chairs with or without arms, low back chairs with or without arms, as well as high back or low back chairs with or without arms which incorporate fixed leg structures.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A passive ergonomic chair comprising:

an open frame construction including a seat frame portion including a first pair of laterally spaced elongated members and a seat back frame portion including a second pair of laterally spaced elongated members;

a hinge connecting said seat frame portion to said seat back frame portion;

a pair of rearward springs underlying respective end bushings of said hinge, each of said rearward springs comprising a relatively rigid curved member having a seat frame engaging portion rigidly secured to corresponding ones of said second pair of laterally spaced elongated members and a seat back frame engaging portion in engagement with corresponding ones of said first pair of said laterally spaced elongated members, and an arcuate portion extending therebetween.

2. A chair according to claim 1 wherein said rearward springs are constructed of reinforced plastic material.

3. A chair according to claim 1 wherein said arcuate portion of said rearward spring establish an angle of about 75° between said seat frame engaging portion and said seat back frame engaging portion.

4. A chair according to claim 1 wherein said arcuate portion has a radius of about 1.8 inches.

5. A chair according to claim 1 wherein said seat engaging portion is substantially straight and extends about 4.5 inches from said arcuate portion.

6. A chair according to claim 1 wherein said seat back engaging portion is substantially straight and extends about 3.5 inches from said arcuate portion.

7. A chair according to claim 1 wherein said rearward springs each have a width of about 2 inches and a thickness of less than 0.5 inch.

8. A chair according to claim 1 wherein said seat frame engaging portion of each of rearward said springs is provided on its underside within elongated rib.

9. A chair according to claim 1 wherein said rib tapers in two opposite directions along at least a portion of the length of the seat frame engaging portion from an intermediate maximum height of about 0.25 inch.

10. A chair according to claim 9 wherein each of said rearward springs as a width of about 2 inches and said rib has a width of about 0.25 inch.

11. A chair according to claim 1 wherein said seat frame portion includes:

a forward lip portion extending across a forward end of said seat frame portion; and a pair of front springs adapted for connection between said seat portion and said forward lip portion of said frame, each of said front springs comprising a substantially straight forward lip engaging portion, and a substantially straight seat frame engaging portion, wherein said forward lip engaging portion and said seat engaging portion of each of said front springs lie substantially in a single plane.

12. A chair according to claim 11 wherein said front springs are constructed of a non-woven fiberglass and epoxy resin composition.

13. A chair according to claim 1 wherein said front springs each have a length of about 4.0 inches, a width of about 1.5 inches, and a thickness of about 0.130 inches.

14. An ergonomic chair comprising:

a substantially open frame construction including a seat frame portion and a seat back frame portion;

a hinge connecting said seat frame portion to said seat back frame portion;

a pair of rearward spring members underlying respective opposite end portions of said hinge, each of said springs comprising a relatively rigid member having a seat frame engaging portion and a seat back frame engaging portion, and an arcuate portion extending therebetween, said seat frame engaging portion rigidly fixed to said seat frame portion;

a forward lip portion extending across a forward end of said seat frame portion;

a pair of front springs adapted for connection between said seat frame portion and said front lip portion of said chair frame, each of said front springs comprising a substantially straight forward lip engaging portion, and a substantially straight seat frame engaging portion; and means for limiting movement of said seat back frame portion relative to said seat frame portion.

15. A chair according to claim 14 wherein said rearward springs are constructed of glass reinforced nylon.

16. A chair according to claim 14 wherein said arcuate hinge portion establishes an angle of about 75° between said seat frame engaging portion and said seat back frame engaging portion.

17. A chair according to claim 14 wherein said arcuate portion has a radius of about 1.8 inches.

18. A chair according to claim 14 wherein said seat engaging portion is substantially straight and extends about 4.5 inches from said arcuate portion.

19. A chair according to claim 18 wherein said seat back engaging portion is substantially straight and extends about 3.5 inches from said arcuate portion.

20. A chair according to claim 14 wherein said back spring has a width of about 2 inches and a thickness of 0.406 inch.

21. A chair according to claim 14 wherein said seat frame engaging portion is provided on its underside within elongated rib.

22. A chair according to claim 20 wherein said rib tapers in two opposite directions along at least a portion of the length of the seat frame engaging portion from an intermediate maximum height of about 0.25 inch.

23. A chair according to claim 20, wherein said rib has a width of about 0.25 inch.

24. A chair according to claim 14 and wherein said front springs are constructed of a non-woven fiberglass and epoxy resin composition.

25. A chair according to claim 14 wherein said front springs each have a length of about 4.0 inches, a width of about 1.5 inches, and a thickness of about 0.130 inches.

26. An ergonomic chair comprising:

a substantially open frame construction including a seat frame portion and a seat back frame portion;

a hinge connecting said seat frame portion to said seat back frame portion;

a pair of rearward spring members underlying respective opposite end portions of said hinge, each of said springs comprising a relatively rigid member having a seat frame engaging portion, a seat back frame engaging portion and an arcuate portion extending therebetween, said seat frame engaging portion provided on its underside with an elongated rib and rigidly fixed to said seat frame portion;

a forward lip portion extending across a forward end of said seat frame portion;

a pair of front springs adapted for connection between said seat frame portion and said front lip portion of said chair frame, each of said front springs comprising a substantially straight forward lip engaging portion, and a substantially straight seat frame engaging portion; and means for limiting movement of said seat back frame portion relative to said seat frame portion.

27. A chair according to claim 26 wherein said rib tapers in two opposite directions along at least a portion of the length of the seat frame engaging portion from an intermediate maximum height of about 0.25 inch.

28. A chair according to claim 14 wherein said seat back frame engaging portion of each said rearward springs is in surface engagement with, but otherwise unsecured to said seat frame portion.

29. A chair according to claim 1 wherein said seat back frame engaging portion of each said rearward springs is in surface engagement with, but otherwise unsecured to said seat frame portion.

* * * * *